US011255634B2

(12) United States Patent
Golan

(10) Patent No.: US 11,255,634 B2
(45) Date of Patent: Feb. 22, 2022

(54) PIVOTING CARBINE CONVERSION ASSEMBLY

(71) Applicant: SILVER SHADOW ADVANCED SECURITY SYSTEMS LTD., Or Yehuda (IL)

(72) Inventor: Amos Golan, Ramat Gan (IL)

(73) Assignee: Silver Shadow Advanced Security Systems Ltd., Or Yehuda (IL)

( * ) Notice: Subject to any disclaimer, the term of this patent is extended or adjusted under 35 U.S.C. 154(b) by 0 days.

(21) Appl. No.: 16/970,706

(22) PCT Filed: Feb. 17, 2019

(86) PCT No.: PCT/IL2019/050190
§ 371 (c)(1),
(2) Date: Aug. 18, 2020

(87) PCT Pub. No.: WO2019/159178
PCT Pub. Date: Aug. 22, 2019

(65) Prior Publication Data

US 2020/0378719 A1 Dec. 3, 2020

(30) Foreign Application Priority Data

Feb. 19, 2018 (IL) ..... 257603

(51) Int. Cl.
*F41C 23/14* (2006.01)
*F41A 17/46* (2006.01)
(Continued)

(52) U.S. Cl.
CPC ..... *F41C 23/14* (2013.01); *F41A 17/46* (2013.01); *F41C 23/04* (2013.01); *F41G 3/165* (2013.01); *F41A 19/09* (2013.01)

(58) Field of Classification Search
CPC ..... F41A 19/08; F41A 19/09; F41C 23/04; F41C 23/14; F41G 3/165
See application file for complete search history.

(56) References Cited

U.S. PATENT DOCUMENTS 4,677,781 A * 7/1987 Lee ..... F41A 11/02 42/70.01
6,598,329 B1 * 7/2003 Alexander ..... F41C 23/04 42/114

(Continued)

FOREIGN PATENT DOCUMENTS

| | | |
|---|---|---|
| KR | 101157823 | 6/2012 |
| WO | 2004/015355 | 2/2004 |
| WO | 2014/035831 | 3/2014 |

OTHER PUBLICATIONS

PCT Search Report and Written Opinion PCT/IL2019/050190, dated May 2, 2019.

*Primary Examiner* — Joshua T Semick
(74) *Attorney, Agent, or Firm* — Dekel Patent Ltd.; David Klein

(57) ABSTRACT

An assembly (10) includes a forward unit (12) including a mounting portion (16) for mounting thereon a firearm, the forward unit (12) defining a projectile shooting axis (20), and a rearward unit (14) coupled to the forward unit (12). The rearward unit (14) includes a retractable buttstock (24) that has a retracted position and an extended position. In the extended position the rearward unit (14) is pivotable with respect to the forward unit (12) about a pivot axis (26) which is tilted relative to the projectile shooting axis (20).

11 Claims, 1 Drawing Sheet

(51) Int. Cl.

| | |
|---|---|
| ***F41C 23/04*** | (2006.01) |
| ***F41G 3/16*** | (2006.01) |
| ***F41A 19/09*** | (2006.01) |

(56) References Cited

U.S. PATENT DOCUMENTS

| | | | | |
|---|---|---|---|---|
| 6,901,691 | B1 * | 6/2005 | Little | F41A 23/02<br>42/118 |
| 7,434,344 | B2 * | 10/2008 | Golan | F41C 23/04<br>42/72 |
| 8,844,185 | B2 * | 9/2014 | Jarboe | F41C 23/14<br>42/73 |
| 9,746,281 | B2 * | 8/2017 | Wilson | F41C 23/14 |
| 9,829,272 | B2 * | 11/2017 | Brown | F41C 23/10 |

* cited by examiner

PIVOTING CARBINE CONVERSION ASSEMBLY

FIELD OF THE INVENTION

The present invention relates to firearms in general and, in particular, to an assembly for shooting around corners.

BACKGROUND OF THE INVENTION

In many cases, it would be desirable to shoot and hit a target lying at an angle to, or around a corner from, a person firing a weapon, such as a handgun or rifle and the like. With conventional firearms, this is impossible, since the barrel is straight and can only be fired forwards or backwards, or else the weapon must be held extended from the body and fired without visually aiming towards the target.

U.S. Pat. No. 6,543,173, assigned to the same assignee as the present application, describes a firearm assembly that permits firing around a corner at a target. In one embodiment, U.S. Pat. No. 6,543,173 describes a firearm assembly comprising a support stock with a stock trigger. A pivotal connector pivotally connects a firearm to the support stock at any desired angle. A trigger connector couples the stock trigger to the trigger of the firearm for remote firing of the firearm.

Pistol carbine conversion kits are well known. The pistol is mounted in an assembly that has a buttstock and which essentially converts the pistol into a carbine that can be shot with the buttstock resting against the shooter's shoulder. The assembly serves as a pistol stabilizer. One of the earliest versions of such a carbine conversion is known from U.S. Pat. No. 1,276,572 from 1918.

SUMMARY OF THE INVENTION

The present invention seeks to provide a corner shooting assembly, in which a handgun or other firearm is mounted in a carbine-type conversion kit or assembly that has a pivotable rearward unit with a retractable buttstock, and pivoting the rearward unit with respect to the firearm enables using the firearm to shoot around corners.

There is thus provided in accordance with a non-limiting embodiment of the present invention an assembly including a forward unit including a mounting portion for mounting thereon a firearm, the forward unit defining a projectile shooting axis, and a rearward unit coupled to the forward unit, the rearward unit including a retractable buttstock that has a retracted position and an extended position, wherein in the extended position the rearward unit is pivotable with respect to the forward unit about a pivot axis which is tilted relative to the projectile shooting axis.

In accordance with a non-limiting embodiment of the present invention the buttstock is more rearward in the extended position than in the retracted position.

In accordance with a non-limiting embodiment of the present invention in the retracted position the rearward unit is not pivotable with respect to the forward unit about the pivot axis.

In accordance with a non-limiting embodiment of the present invention the rearward unit is coupled to the forward unit with a hinge connector, and the hinge connector is blocked by a portion of the rearward unit in the retracted position that prevents pivoting the rearward unit about the pivot axis and the hinge connector is not blocked by the portion of the rearward unit in the extended position thereby permitting pivoting the rearward unit about the pivot axis.

In accordance with a non-limiting embodiment of the present invention the rearward unit includes a rear trigger and a link member for coupling the rear trigger to a trigger of a firearm mounted in the forward unit.

In accordance with a non-limiting embodiment of the present invention the rearward unit includes a display screen in communication with a camera mounted in the forward unit, the display screen configured to display images along the projectile shooting axis acquired by the camera.

In accordance with a non-limiting embodiment of the present invention the hinge connector is lockable in at least one angular position of the rearward unit with respect to the forward unit.

In accordance with a non-limiting embodiment of the present invention the assembly further includes a firearm mounted in the forward unit.

In accordance with a non-limiting embodiment of the present invention the forward unit includes a tactical rail for mounting accessories thereon.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
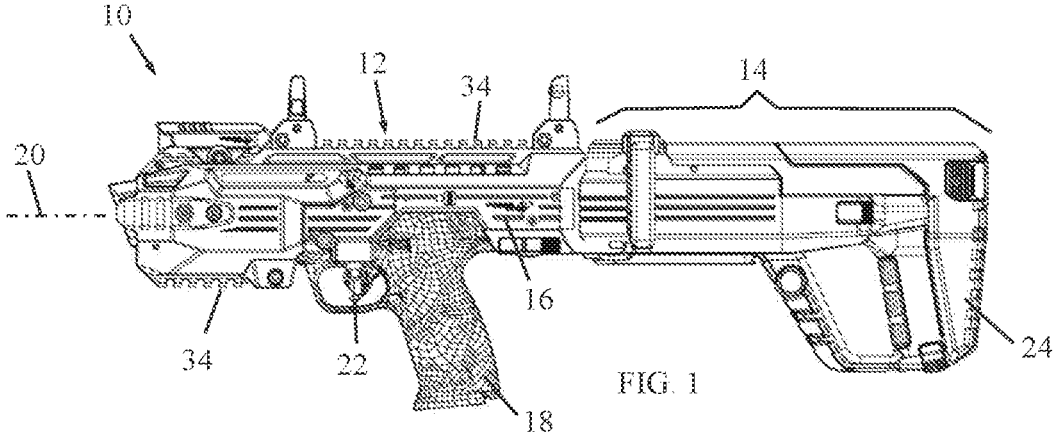
FIG. 1 is a simplified perspective illustration of a corner shooting assembly, in accordance with a non-limiting embodiment of the present invention, in which a buttstock is in a retracted position.
Figure 2:
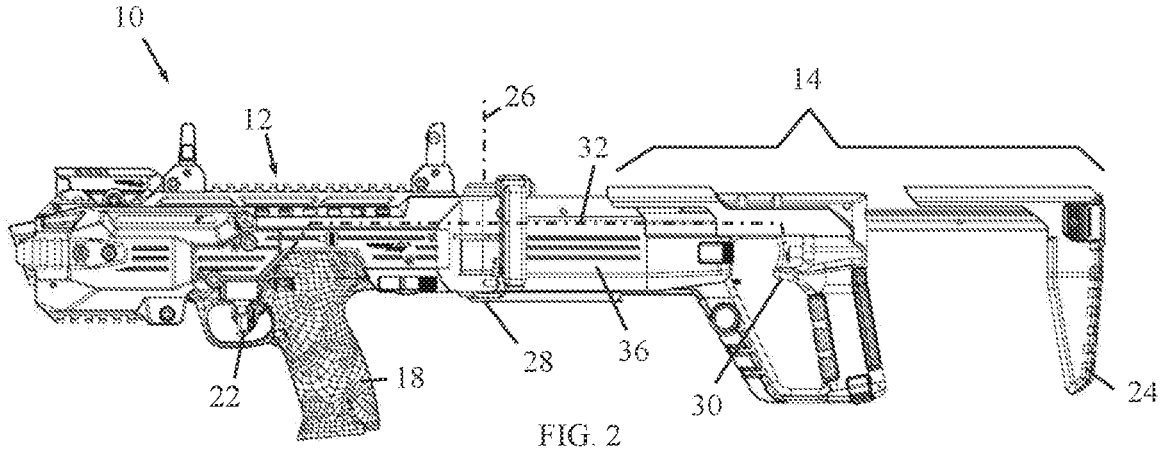
FIG. 2 is a simplified perspective illustration of the corner shooting assembly, in which the buttstock is in an extended position.
Figure 3:
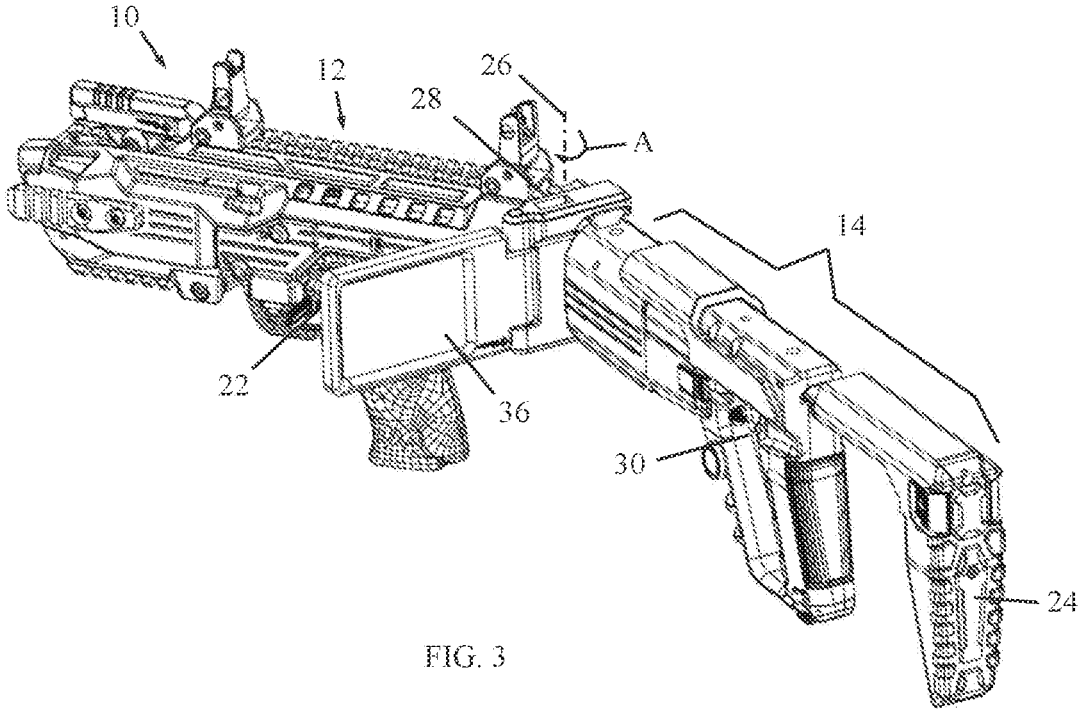
FIG. 3 is a simplified perspective illustration of the corner shooting assembly, in which a forward unit is pivoted with respect to a rearward unit.

Reference is now made to FIGS. 1-3, which illustrate a corner shooting assembly 10, in accordance with a non-limiting embodiment of the present invention.

The corner shooting assembly 10 includes a forward unit 12 and a rearward unit 14 coupled to the forward unit 12. The forward unit 12 includes a mounting portion 16 for mounting thereon a firearm 18, such as a handgun. The forward unit 12 defines a projectile shooting axis 20. The mounting portion 16 may include fasteners, lugs, clips, detents, etc. for affixing the firearm 18 in place so the firearm 18 is fixedly held during firing thereof. The firearm 18 has a trigger 22. The firearm 18 may be a lethal or non-lethal weapon or a toy, as is known.

The rearward unit 14 includes a retractable buttstock 24 that has a retracted position (FIG. 1) and an extended position (FIGS. 2 and 3). As seen in FIG. 3, in the extended position, the rearward unit 14 is pivotable (through an angle A) with respect to the forward unit 12 about a pivot axis 26 which is tilted relative to the projectile shooting axis 20. In the illustrated embodiment, pivot axis 26 is perpendicular to the projectile shooting axis 20 and rearward unit 14 pivots with respect to forward unit 12 in azimuth. The angle A may be from 0-180°.

In accordance with a non-limiting embodiment of the present invention the rearward unit 14 is coupled to the forward unit 12 with a hinge connector 28, such as but not limited to, a hinge pin, a ratchet mechanism in which there are one or more locked positions, a detent mechanism, and the like. Thus, the hinge connector 28 may be lockable in at least one angular position of the rearward unit 14 with respect to the forward unit 12.

The hinge connector 28 is blocked by a portion of the rearward unit 14 in the retracted position that prevents pivoting the rearward unit 14 about the pivot axis 26. For example, the rearward unit 14 may cover hinge connector 28 to prevent pivoting, or rearward unit 14 may include a lug, tongue or other mechanism that protrudes into hinge connector 28 or forward unit 12 to prevent pivoting. Conversely, the hinge connector 28 is not blocked by the rearward unit 14 in the extended position thereby permitting pivoting the rearward unit 14 about the pivot axis 26. For example, the rearward unit 14 may move and expose hinge connector 28 to permit pivoting, or the lug, tongue or other mechanism may be extracted from hinge connector 28 or forward unit 12 to permit pivoting.

As seen from FIG. 2, buttstock 24 is more rearward in the extended position than in the retracted position.

In accordance with a non-limiting embodiment of the present invention the rearward unit 14 includes a rear trigger 30 and a link member 32 for coupling the rear trigger 30 to trigger 22 of firearm 18 mounted in the forward unit 12. For example, link member 32 may be a wire that connects the two triggers together. Alternatively, a motor or other actuator may be mounted near trigger 22 which is remotely controlled by rear trigger 30.

In accordance with a non-limiting embodiment of the present invention, in the retracted position the rear trigger 30 is covered by a portion of the rearward unit 14 so that the rear trigger 30 is not accessible; only trigger 22 of firearm 18 may be used in the retracted position. In addition, the link member 32 may serve as a trigger safety. For example, in the retracted position, the link member 32 may become disconnected so there is no connection between rear trigger 30 and trigger 22 (the triggers are decoupled). The link member 32 becomes engaged with both triggers 22 and 30 only in the extended position to permit using rear trigger 30 to shoot with firearm 18.

The forward unit 12 and/or the rearward unit 14 may include one or more tactical rails 34 for mounting items, such as but not limited to, a flashlight, laser scope and others.

In accordance with a non-limiting embodiment of the present invention the rearward unit 14 includes a display screen 36 (which may be foldable in to the rearward unit in the retracted position) in communication with a camera 38 mounted in the forward unit 12. Display screen 36 displays images along the projectile shooting axis 20 acquired by camera 38.

The corner shooting assembly 10 may be used in the retracted position as a firearm stabilizer, similar to other pistol carbine conversions. In the extended position, the forward unit 12 may be pivoted with respect to the rearward unit 14 and the corner shooting assembly 10 may be used to shoot around corners and the like.

What is claimed is:

1. An assembly comprising:

a forward unit comprising a mounting portion for mounting thereon a firearm, said forward unit defining a projectile shooting axis; and a rearward unit coupled to said forward unit, said rearward unit comprising a retractable buttstock that has a retracted position and an extended position, wherein in the extended position said rearward unit is pivotable with respect to said forward unit about a pivot axis which is tilted relative to said projectile shooting axis, wherein said rearward unit comprises a rear trigger and a link member configured to couple said rear trigger to a trigger of a firearm, and wherein said rear trigger is inaccessible in said retracted position.

2. The assembly according to claim 1, wherein said buttstock is more rearward in the extended position than in the retracted position.

3. The assembly according to claim 1, wherein in the retracted position said rearward unit is not pivotable with respect to said forward unit about the pivot axis.

4. The assembly according to claim 1, wherein said hinge connector is blocked by a portion of said rearward unit in the retracted position that prevents pivoting said rearward unit about the pivot axis and said hinge connector is not blocked by said portion of said rearward unit in the extended position thereby permitting pivoting said rearward unit about the pivot axis.

5. The assembly according to claim 1, wherein said rearward unit comprises a rear trigger and a link member for coupling said rear trigger to a trigger of a firearm mounted in said forward unit.

6. The assembly according to claim 1, wherein said rearward unit comprises a display screen in communication with a camera mounted in said forward unit, said display screen configured to display images along said projectile shooting axis acquired by said camera.

7. The assembly according to claim 1, wherein said hinge connector is lockable in at least one angular position of said rearward unit with respect to said forward unit.

8. The assembly according to claim 1, further comprising a firearm mounted in said forward unit.

9. The assembly according to claim 8, wherein said rearward unit comprises a rear trigger and a link member that couples said rear trigger to a trigger of said firearm.

10. The assembly according to claim 1, wherein said forward unit or rearward unit comprises a tactical rail for mounting accessories thereon.

11. The assembly according to claim 9, wherein said link member comprises a trigger safety that decouples said rear trigger from said trigger of said firearm in said retracted position.

* * * * *